US008482213B1

(12) United States Patent
Xiong et al.

(10) Patent No.: US 8,482,213 B1
(45) Date of Patent: Jul. 9, 2013

(54) ELECTRONIC BALLAST WITH PULSE DETECTION CIRCUIT FOR LAMP END OF LIFE AND OUTPUT SHORT PROTECTION

(75) Inventors: Wei Xiong, Madison, AL (US); Thomas Lunn, Hazel Green, AL (US); Christopher Radzinski, Huntsville, AL (US)

(73) Assignee: Panasonic Corporation, Osaka (JP)

( * ) Notice: Subject to any disclaimer, the term of this patent is extended or adjusted under 35 U.S.C. 154(b) by 467 days.

(21) Appl. No.: 12/825,573

(22) Filed: Jun. 29, 2010

Related U.S. Application Data

(60) Provisional application No. 61/221,512, filed on Jun. 29, 2009.

(51) Int. Cl.
*H05B 37/02* (2006.01)

(52) U.S. Cl.
USPC ..... 315/224; 315/307

(58) Field of Classification Search
USPC ..... 315/209 R, 224–226, 227 R, 241 R, 315/243, 283, 291, 307
See application file for complete search history.

(56) References Cited

U.S. PATENT DOCUMENTS

| | | | |
|---|---|---|---|
| 3,562,580 | A | 2/1971 | Blomgren |
| 3,577,173 | A | 5/1971 | Blomgren |
| 3,671,955 | A | 6/1972 | Malekzadeh |
| 3,995,262 | A | 11/1976 | France et al. |
| 4,039,895 | A | 8/1977 | Chermin et al. |
| 4,222,047 | A | 9/1980 | Finnegan |
| 4,249,111 | A | 2/1981 | Gluck |
| 4,382,212 | A | 5/1983 | Bay |
| 4,429,356 | A | 1/1984 | Inui et al. |
| 4,488,199 | A | 12/1984 | Bloomer |
| 4,501,992 | A | 2/1985 | Evans et al. |
| 4,555,587 | A | 11/1985 | Argentieri |
| 4,667,131 | A | 5/1987 | Nilssen |
| 4,810,936 | A | 3/1989 | Nuckolls et al. |
| RE32,901 | E | 4/1989 | Nilssen |
| RE32,953 | E | 6/1989 | Nilssen |
| 5,023,516 | A | 6/1991 | Ito et al. |
| 5,055,747 | A | 10/1991 | Johns |
| 5,068,570 | A | 11/1991 | Oda et al. |
| 5,089,753 | A | 2/1992 | Mattas |
| 5,111,114 | A | 5/1992 | Wang |
| 5,138,235 | A | 8/1992 | Sun et al. |
| 5,142,202 | A | 8/1992 | Sun et al. |

(Continued)

FOREIGN PATENT DOCUMENTS

| | | |
|---|---|---|
| CA | 1013840 | 7/1977 |
| JP | 1149398 | 6/1989 |

(Continued)

*Primary Examiner* — Jimmy Vu
(74) *Attorney, Agent, or Firm* — Waddey & Patterson, P.C.; Mark J. Patterson

(57) ABSTRACT

An electronic ballast for fluorescent lighting includes an inverter circuit having an output circuit coupled to a pair of lamp terminals. A protection circuit is coupled to one of the lamp terminals. The protection circuit includes a differential voltage sensing circuit that is functional to sense the lamp voltage pulses as sudden changes in voltage across a DC blocking capacitor and, in response, to provide a positive AC voltage pulse. A pulse accumulation circuit is coupled to the differential voltage sensing circuit. The pulse accumulation circuit is responsive to the positive AC voltage pulses from the differential voltage sensing circuit to accumulate the positive AC voltage pulses into the ballast shutdown signal.

11 Claims, 2 Drawing Sheets

U.S. PATENT DOCUMENTS

| | | | |
|---|---|---|---|
| 5,220,247 | A | 6/1993 | Moisin |
| 5,262,699 | A | 11/1993 | Sun et al. |
| 5,293,099 | A | 3/1994 | Bobel |
| 5,321,337 | A | 6/1994 | Hsu |
| 5,332,951 | A | 7/1994 | Turner et al. |
| 5,387,846 | A | 2/1995 | So |
| 5,436,529 | A | 7/1995 | Bobel |
| 5,475,284 | A | 12/1995 | Lester et al. |
| 5,493,180 | A | 2/1996 | Bezdon et al. |
| 5,500,576 | A | 3/1996 | Russell et al. |
| 5,574,335 | A | 11/1996 | Sun |
| 5,606,224 | A | 2/1997 | Hua |
| 5,619,105 | A | 4/1997 | Holmquest |
| 5,635,799 | A | 6/1997 | Hesterman |
| 5,636,111 | A | 6/1997 | Griffin et al. |
| 5,650,694 | A | 7/1997 | Jayaraman et al. |
| 5,705,894 | A | 1/1998 | Krummel |
| 5,717,295 | A | 2/1998 | Nerone |
| 5,729,096 | A | 3/1998 | Liu et al. |
| 5,739,645 | A | 4/1998 | Xia et al. |
| 5,744,912 | A | 4/1998 | So |
| 5,751,115 | A | 5/1998 | Jauaraman et al. |
| 5,751,120 | A | 5/1998 | Zeitler et al. |
| 5,783,911 | A | 7/1998 | Rudolph |
| 5,818,669 | A | 10/1998 | Mader |
| 5,844,197 | A | 12/1998 | Daniel |
| 5,869,935 | A | 2/1999 | Sodhi |
| 5,872,429 | A | 2/1999 | Xia et al. |
| 5,883,473 | A | 3/1999 | Li et al. |
| 5,930,126 | A | 7/1999 | Griffin et al. |
| 5,932,974 | A | 8/1999 | Wood |
| 5,939,832 | A | 8/1999 | Franck |
| 5,945,788 | A | 8/1999 | Li et al. |
| 6,008,592 | A | 12/1999 | Ribarich |
| 6,177,768 | B1 | 1/2001 | Kamata et al. |
| 6,198,231 | B1 | 3/2001 | Schemmel et al. |
| 6,222,322 | B1 | 4/2001 | Stack |
| 6,232,727 | B1 | 5/2001 | Chee et al. |
| 6,274,987 | B1 | 8/2001 | Burke |
| 6,292,339 | B1 | 9/2001 | Brooks |
| 6,400,095 | B1 | 6/2002 | Primisser et al. |
| 6,429,603 | B1 | 8/2002 | Tsugita et al. |
| 6,501,225 | B1 | 12/2002 | Konopka |
| 6,545,432 | B2 | 4/2003 | Konopka |
| 6,552,501 | B2 | 4/2003 | Ito et al. |
| 6,646,390 | B2 | 11/2003 | Grabner et al. |
| 6,696,798 | B2 | 2/2004 | Nishimoto et al. |
| 6,720,739 | B2 | 4/2004 | Konopka |
| 6,741,043 | B2 | 5/2004 | Prasad |
| 6,803,731 | B2 | 10/2004 | Grabner et al. |
| 6,809,483 | B2 | 10/2004 | Alexandrov |
| 6,819,063 | B2 | 11/2004 | Nemirow |
| 7,042,161 | B1 | 5/2006 | Konopka |
| 7,102,297 | B2 | 9/2006 | Trestman et al. |
| 7,154,232 | B2 | 12/2006 | Contenti et al. |
| 7,208,887 | B2 | 4/2007 | Mosebrook et al. |
| 7,211,966 | B2 | 5/2007 | Green et al. |
| 7,247,998 | B2 | 7/2007 | Poehlman et al. |
| 7,291,992 | B2 | 11/2007 | Miyazaki |
| 7,298,099 | B2 | 11/2007 | Ribarich |
| 7,312,588 | B1 | 12/2007 | Yu et al. |
| 7,327,101 | B1 | 2/2008 | Chen et al. |
| 7,368,883 | B2 | 5/2008 | Chan et al. |
| 7,589,476 | B2 * | 9/2009 | Parker et al. ..... 315/219 |
| 2005/0046357 | A1 | 3/2005 | Stack |
| 2007/0029943 | A1 | 2/2007 | Erhardt et al. |
| 2010/0001650 | A1 * | 1/2010 | Hamana et al. ..... 315/119 |

FOREIGN PATENT DOCUMENTS

| | | |
|---|---|---|
| JP | 4322047 | 11/1992 |
| JP | 5226090 | 9/1993 |
| JP | 5326181 | 12/1993 |
| JP | 10312892 | 11/1998 |
| JP | 11111476 | 4/1999 |
| JP | 2000277290 | 10/2000 |
| JP | 2003059681 | 10/2003 |
| JP | 2004303530 | 10/2004 |
| JP | 2005243305 | 9/2005 |
| JP | 2007188798 | 7/2007 |
| KR | 20050011078 | 1/2005 |
| WO | WO2005101921 | 10/2005 |

* cited by examiner

ELECTRONIC BALLAST WITH PULSE DETECTION CIRCUIT FOR LAMP END OF LIFE AND OUTPUT SHORT PROTECTION

CROSS-REFERENCES TO RELATED APPLICATIONS

This application claims benefit of the following patent application(s) which is/are hereby incorporated by reference: U.S. Provisional Patent Application No. 61/221,512, filed Jun. 29, 2009.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to electronic ballasts for powering gas discharge lamps.

More particularly, this invention pertains to circuits and methods using in an electronic ballast for detecting a lamp end of life condition and/or a short-circuit fault condition at the ballast output.

For safety and equipment reliability purposes, electronic ballasts used in fluorescent lighting must include protection circuitry for lamp end of life (EOL) conditions. This need is particularly significant for T5 or smaller lamps. Preferably, the EOL protection circuit will shut down the ballast when the lamp reaches an EOL condition.

A typical class D inverter topology for an electronic ballast is shown in FIG. 1. A DC rail voltage V_rail is conventionally outputted by a voltage source such as a power factor correction (PFC) section (not shown) or a rectifier circuit (not shown). The rail voltage V_rail is converted by a half-bridge inverter into a high frequency AC voltage. In the embodiment of FIG. 1, switching elements Q1 and Q2 are MOSFETs that are driven by an IC driver circuit. Capacitor C_dc_blocking is a DC blocking capacitor which prevents DC current from going through the resonant inverter output circuit defined by resonant inductor T_resonant and resonant capacitor C_resonant. A gas discharge lamp (Lamp) is connected across the resonant capacitor C_resonant. The resonant circuit provides proper lamp starting and steady state voltages for the Lamp. Capacitor C_lamp_block is also a DC blocking capacitor to prevent any DC current from passing through the lamp in the output.

When a fluorescent lamp reaches its end of life, the lamp voltage typically pulses asymmetrically and the lamp may exhibit visible flickering. The asymmetric pulse will generate a DC voltage offset across the lamp.

What is needed is a lamp EOL protection circuit for an electronic ballast that can exploit the existence of the asymmetric lamp voltage pulses to sense that the lamp is in an end of life condition and then initiate appropriate actions to protect the ballast.

BRIEF SUMMARY OF THE INVENTION

In one aspect, the electronic ballast of the present invention includes an inverter circuit having an output circuit coupled to a pair of lamp terminals. A protection circuit is coupled to one of the lamp terminals. The protection circuit is configured to detect lamp voltage pulses that occur at the lamp terminal when a lamp coupled to the lamp terminals reaches an end of life condition. The protection circuit may accumulate the lamp voltage pulses into a ballast shut down signal that is usable by the ballast to initiate shut down of the ballast when the accumulated ballast shut down signal reaches a predetermined shutdown level.

In another aspect, the electronic ballast may have a DC blocking capacitor connected between the lamp terminal and circuit ground. In this embodiment the protection circuit may include a differential voltage sensing circuit coupled to the DC blocking capacitor. The differential voltage sensing circuit may be configured to sense the lamp voltage pulses as sudden changes in voltage across the DC blocking capacitor and, in response, to provide a positive AC voltage pulse.

In yet another aspect, the protection circuit of the present invention may include a pulse accumulation circuit coupled to the differential voltage sensing circuit. The pulse accumulation circuit may be responsive to the positive AC voltage pulses from the differential voltage sensing circuit to accumulate the positive AC voltage pulses into the ballast shutdown signal.

In a further aspect, the electronic ballast of the present invention may respond to a short circuit fault at the lamp terminals by generating an abnormally high AC voltage at the lamp terminals. In one embodiment, the pulse accumulation circuit may be configured such that during the short circuit fault, a capacitor will be continuously charged until the ballast shutdown signal reaches a predetermined shutdown level.

In still another aspect, the electronic ballast of the present invention may include a pulse accumulation circuit that is configured to rapidly discharge a first capacitor after a shutdown of the ballast so that charging of a second capacitor is inhibited.

DETAILED DESCRIPTION OF THE INVENTION

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices.

The term "circuit" means at least either a single component or a multiplicity of components, either active and/or passive, that are coupled together to provide a desired function.

The term "signal" means at least one current, voltage, charge, temperature, data or other signal.

The terms "switching element" and "switch" may be used interchangeably and may refer herein to at least: a variety of transistors as known in the art (including but not limited to FET, BJT, IGBT, IGFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

The terms "power converter" and "converter" unless otherwise defined with respect to a particular element may be used interchangeably herein and with reference to at least DC-DC, DC-AC, AC-DC, buck, buck-boost, boost, half-bridge, full-bridge, H-bridge or various other forms of power conversion or inversion as known to one of skill in the art.

The term "controller" as used herein may refer to at least a general microprocessor, an application specific integrated circuit (ASIC), a digital signal processor (DSP), a microcontroller, a field programmable gate array, or various alternative blocks of discrete circuitry as known in the art, designed to perform functions as further defined herein.

Figure 1:
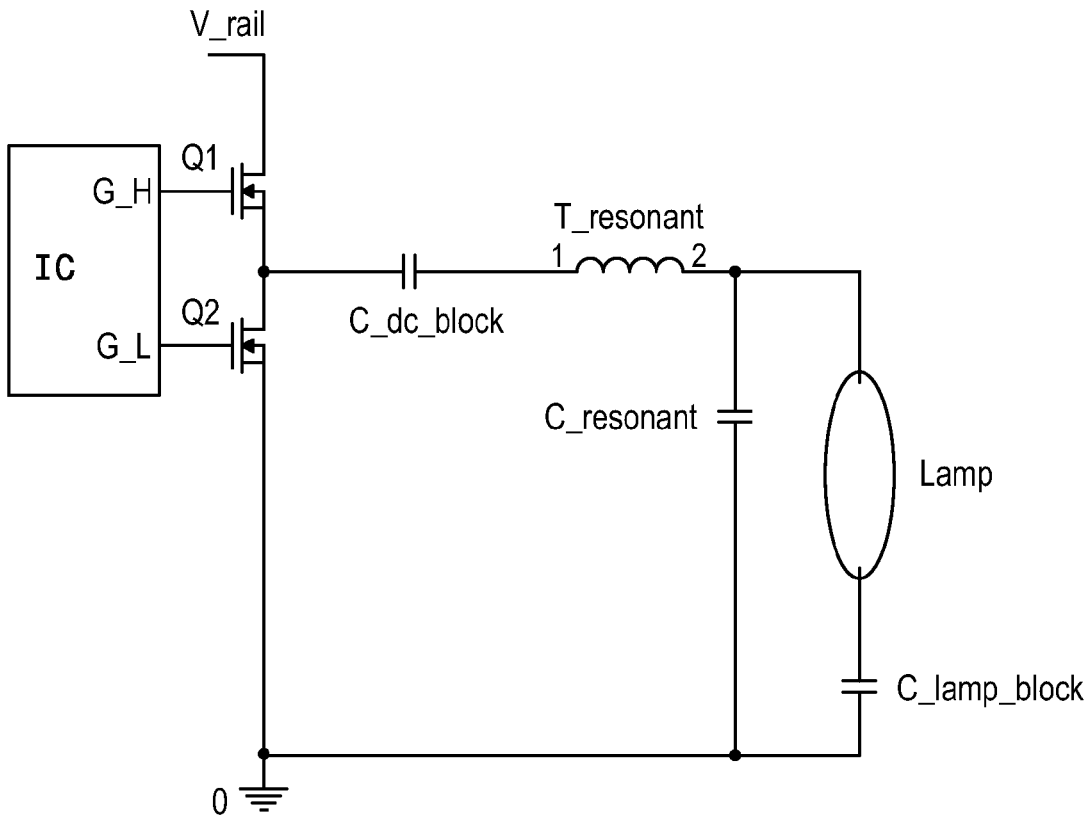
FIG. 1 (PRIOR ART)
FIG. 1 is a schematic diagram of a conventional electronic ballast circuit.
Figure 2:
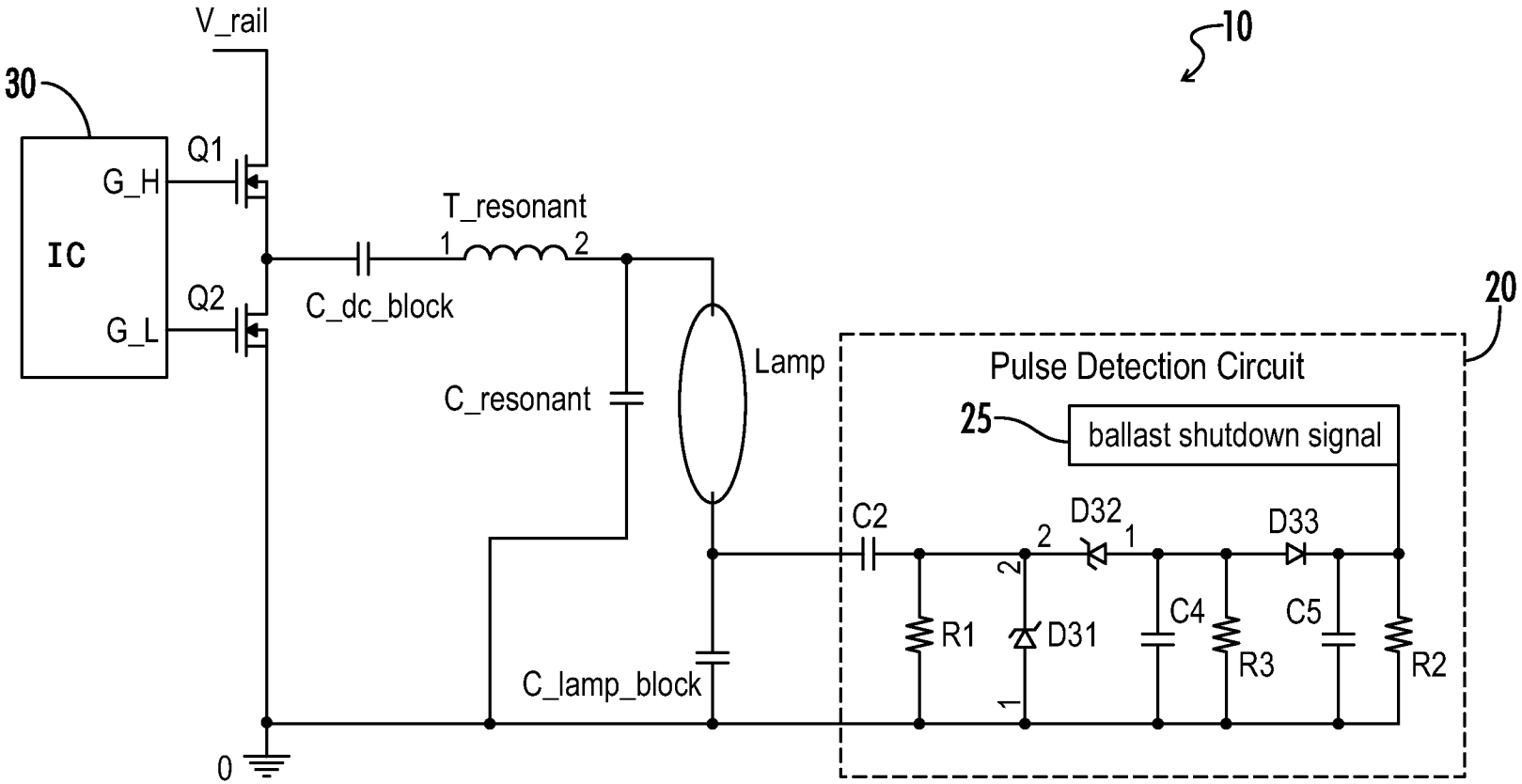
FIG. 2 is a schematic diagram of one embodiment of electronic ballast with a lamp EOL detection and protection circuit in accordance with the present invention.

Referring generally to FIG. 2, one embodiment of an electronic ballast 10 with a lamp EOL detection output short protection circuit 20 may be described. Where the ballast of FIGS. 1 and 2 share common elements and features, similar elements and features are given the same reference numerals and redundant description thereof is be omitted below.

In the protection circuit 20, a first end of a capacitor C2 is coupled to a node between one lamp terminal and capacitor C_lamp_block. The second end of capacitor C2 is connected to a first end of resistor R1. The second end of resistor R1 is connected to circuit ground. Capacitor C2 and resistor R1 form a differential voltage sensing circuit which senses either a sudden change in DC voltage across capacitor C_lamp_block or a large change in AC voltage across the Lamp. Thus, capacitor C2 may also be referred to as a sensing circuit capacitor and resistor R1 may be referred to as a sensing circuit resistor.

The cathode of a diode D31 is connected to the junction of capacitor C2 and resistor R1. The anode of diode D31 is connected to circuit ground. Diode D31 may be a Zener diode that is configured to clamp the voltage across resistor R1 during initial lamp start-up.

The cathode of a first pulse accumulation circuit diode D32 may be connected to the junction of capacitor C2, resistor R1, and cathode of diode D31. First diode D32 may be a zener diode that senses high positive voltage pulses across resistor R1. A first pulse accumulation circuit capacitor C4 may be connected between the anode of diode D32 and circuit ground. The reverse breakdown voltage of diode D32 may be chosen such that during normal steady-state operation of the lamp and ballast, the voltage across first capacitor C4 is a negative AC voltage. A first pulse accumulation circuit resistor R3 may be connected in parallel with first capacitor C4 to provide a discharge path for first capacitor C4. The anode of a second pulse accumulation circuit diode D33 may be connected to the junction of the anode of first diode D32, first capacitor C4 and first resistor R3. A second pulse accumulation circuit capacitor C5 may be connected between the cathode of second diode D33 and circuit ground. Second diode D33 and second capacitor C5 may form an accumulation rectifying circuit that collects and accumulates positive voltage pulses across first capacitor C4 and provides a steady positive voltage signal that may be used as a pulse detection signal. A second pulse accumulation circuit resistor R2 may be connected in parallel with second capacitor C5. Thus, the arrangement of first diode D32, first capacitor C4, first resistor R3, second diode D33, second capacitor C5 and a second resistor R2 may be described as positive pulse accumulation circuit or simply, a pulse accumulation circuit.

The pulse detection signal from the pulse accumulation circuit may be used as a ballast shutdown signal 25 to shut down or disable operation of the ballast 10. Use of a shut down signal to disable or shut down an electronic ballast is well known in the art. In one embodiment, the ballast shutdown signal 25 may be coupled to an analog or digital shutdown input on driver IC 30. In response to receiving the ballast shutdown signal 25 at a predetermined shutdown level, the driver IC 30 terminates gate drive signals to the inverter switching elements Q1 and Q2.

The method of operation of the electronic ballast 10 and protection circuit 20 of FIG. 2 may now be described. During normal operation of the ballast inverter, the voltage cross sensing resistor R1 will be small magnitude AC voltage. The reverse breakdown voltage of first diode D32 may be selected to be significantly larger than the positive peak voltage of the normal, small magnitude AC voltage across sensing resistor R1. Therefore, there will be no positive voltage pulses across first capacitor C4 under normal operating conditions of the Lamp.

Whenever the Lamp reaches an EOL condition, the lamp voltage will begin to pulse. This pulse will generate a sudden DC offset voltage across the Lamp and across blocking capacitor C_lamp_blocking. The differential voltage sensing circuit (capacitor C2 and resistor R1) will sense this sudden DC voltage change and transfer it as a large AC voltage pulse across sensing resistor R1. The large AC voltage pulse then quickly charges first capacitor C4 through first diode D32, if the peak voltage of the pulse is larger than the breakdown voltage of first diode D32. If the lamp voltage pulses are continuous, second capacitor C5 will be charged through second diode D33 to a predetermined ballast shutdown signal level, which can be set to initiate shutdown of ballast 10 such as by causing driver IC 30 to terminate gate drive signals to the inverter switching elements Q1 and Q2.

After the ballast 10 is shut down, the voltage across sensing resistor R1 will immediately drop to zero because there is no AC signal across the Lamp. First capacitor C4 will then be quickly discharged through first diode D32 and sensing resistor R1. Accordingly, the charge remaining in capacitor C4 will not maintain charging of capacitor C5 after the inverter 10 is shutdown. This fast voltage reset will insure reliable lamp starting. Thus the sensing circuit resistor R1 and first capacitor C4 in the pulse accumulation circuit may be configured to rapidly discharge the first capacitor C4 after a shutdown of the ballast so that further charging of the second capacitor C5 is inhibited.

The protection circuit 20 may also provide protection of the ballast 10 if there is a short circuit fault at the output of the inverter. For example, when the inverter output is shorted there will be a large magnitude AC voltage across capacitor C_lamp_blocking and sensing resistor R1. This large AC voltage will continuously charge capacitors C4 and C5 until the voltage across capacitor C5 reaches the preset level for inverter shutdown.

Thus, although there have been described particular embodiments of the present invention of a new and useful electronic ballast with pulse detection circuit for lamp end of life and output short protection, it is not intended that such references be construed as limitations upon the scope of this invention except as set forth in the following claims.

What is claimed is:

1. An electronic ballast comprising:

an inverter circuit having an output circuit coupled to a pair of lamp terminals;

a protection circuit coupled to one of the lamp terminals;

wherein the protection circuit is functional to detect lamp voltage pulses that occur at the lamp terminal when a lamp coupled to the lamp terminals reaches an end of life condition, and to accumulate the lamp voltage pulses into a ballast shut down signal that is usable by the ballast to initiate shut down of the ballast when the accumulated ballast shut down signal reaches a predetermined shutdown level;

a DC blocking capacitor connected between the lamp terminal and circuit ground; and the protection circuit comprises a differential voltage sensing circuit coupled to the DC blocking capacitor and functional to sense the lamp voltage pulses as sudden changes in voltage across the DC blocking capacitor and, in response, to provide a positive AC voltage pulse, and a pulse accumulation circuit coupled to the differential voltage sensing circuit, the pulse accumulation circuit being responsive to the positive AC voltage pulses from the differential voltage sensing circuit to accumulate the positive AC voltage pulses into the ballast shutdown signal.

2. The electronic ballast of claim 1 wherein the differential voltage sensing circuit comprises:

a sensing circuit capacitor having a first end coupled to the DC blocking capacitor; and a sensing circuit resistor having a first end coupled to a second end of the sensing circuit capacitor and a second end coupled to circuit ground.

3. The electronic ballast of claim 1 wherein the pulse accumulation circuit comprises:

a first diode having an anode and a cathode, the cathode of the first diode connected to the second end of the sensing circuit capacitor;

a first capacitor connected between the anode of the first diode and circuit ground;

a first resistor connected across the first capacitor;

a second diode having an anode and a cathode, the anode of the second diode coupled to the anode of the first diode;

a second capacitor connected between the cathode of the second diode and circuit ground; and the first diode has a reverse breakdown voltage selected so that during normal lamp operation no positive voltage pulses are present at the anode of the first diode and such that during a lamp end of life condition, positive pulses are present at the anode of the first diode so that the ballast shutdown signal is accumulated at the cathode of the second diode.

4. The electronic ballast of claim 3 wherein the pulse accumulation circuit further comprises a second resistor connected in parallel with the second capacitor.

5. The electronic ballast of claim 4 wherein the first diode is a zener diode.

6. The electronic ballast of claim 5 wherein during a short circuit fault at the lamp terminals, an abnormally high AC voltage will be present at the DC blocking capacitor, and the pulse accumulation circuit is configured such that during the short circuit fault, the second capacitor will be continuously charged until the ballast shutdown signal reaches the predetermined shutdown level.

7. The electronic ballast of claim 6 further comprising a clamp circuit connected in across the sensing circuit resistor.

8. The electronic ballast of claim 7 wherein the clamp circuit comprises a zener diode configured to clamp the voltage across the sensing circuit resistor during initial start-up of a lamp connected to the lamp terminals.

9. The electronic ballast of claim 8 wherein the sensing circuit resistor and first capacitor in the pulse accumulation circuit are configured to rapidly discharge the first capacitor after a shutdown of the ballast so that charging of the second capacitor is inhibited.

10. A method of providing a ballast shutdown signal for shutting down an electronic ballast when a lamp connected to the ballast reaches an end of life condition, comprising:

sensing asymmetric pulses in the lamp voltage associated with lamp end of life;

accumulating a plurality of the sensed end of life voltage pulses as a ballast shutdown signal; and wherein the step of sensing asymmetric pulses in the lamp voltage at lamp end of life comprises sensing changes in a DC voltage appearing across a DC blocking capacitor connected to a lamp terminal in the ballast, and using a differential voltage sensing circuit to sense the end of life lamp voltage pulses as sudden changes in voltage across a DC blocking capacitor and, in response, to provide a positive AC voltage pulse.

11. The method of claim 10 wherein the step of providing a positive voltage pulse comprises coupling an output from the differential voltage circuit to a cathode of a zener diode having a breakdown voltage selected so that only end of life voltage pulses are accumulated.

* * * * *

UNITED STATES PATENT AND TRADEMARK OFFICE

CERTIFICATE OF CORRECTION

PATENT NO. : 8,482,213 B1
APPLICATION NO. : 12/825573
DATED : July 9, 2013
INVENTOR(S) : Wei Xiong, Thomas Lunn and Christopher Radzinski It is certified that error appears in the above-identified patent and that said Letters Patent is hereby corrected as shown below:

Title Page, Item (73), replace "Panasonic Corporation, Osaka (JP)" with --Universal Lighting Technologies, Inc., Madison, AL--.

Signed and Sealed this
Twenty-fourth Day of December, 2013

Margaret A. Focarino

Margaret A. Focarino
*Commissioner for Patents of the United States Patent and Trademark Office*